United States Patent [19]

Stephan et al.

[11] 4,295,808

[45] Oct. 20, 1981

[54] APPARATUS FOR THE PRODUCTION OF HIGH-PURITY METAL POWDER BY MEANS OF ELECTRON BEAM HEATING

[75] Inventors: Herbert Stephan, Bruchköbel; Hans Aichert, Hanau am Main; Joseph Heimerl, Altenhässlau, all of Fed. Rep. of Germany

[73] Assignee: Leybold-Heraeus GmbH & Co. KG, Cologne, Fed. Rep. of Germany

[21] Appl. No.: 85,155

[22] Filed: Oct. 15, 1979

Related U.S. Application Data

[60] Division of Ser. No. 902,475, May 7, 1978, Pat. No. 4,218,410, which is a continuation of Ser. No. 697,283, Jun. 17, 1976, abandoned.

[30] Foreign Application Priority Data

Jun. 28, 1977 [DE] Fed. Rep. of Germany ..... 2528999

[51] Int. Cl.[3] ..... B22F 9/00

[52] U.S. Cl. ..... 425/8; 425/174

[58] Field of Search ..... 425/8, 174

[56] References Cited

U.S. PATENT DOCUMENTS

| | | | |
|---|---|---|---|
| 3,275,787 | 9/1966 | Newberry | 264/10 |
| 3,582,529 | 6/1971 | Anderson et al. | 13/31 |
| 3,721,511 | 3/1973 | Schlienger | 264/10 |
| 3,829,538 | 8/1974 | Daymara et al. | 425/8 |
| 3,869,232 | 3/1975 | Ruus et al. | 264/25 |
| 3,963,812 | 6/1976 | Schlienger | 425/8 |

*Primary Examiner*—James R. Hall

*Attorney, Agent, or Firm*—Sprung, Felfe, Horn, Lynch & Kramer

[57] ABSTRACT

High-purity metal powder is made by the electron beam melting of a starting material in rod form in a vacuum wherein the molten metal is momentarily caught on a spinning plate rotating at high speed and flung therefrom and thereafter solidified by cooling. The metal on the spinning plate is bombarded with an electron beam that is so focused and periodically deflected that its focal spot is many times smaller than the diameter of the spinning plate. The beam deflection between the rotational center of the spinning plate and its marginal area is performed such that the spinning plate is scanned in a zone that extends radially of the axis of rotation of the spinning plate and is small in relation to its diameter. Cooling of the metal particles to the point of solidification is accomplished by radiation loss.

12 Claims, 5 Drawing Figures

Figure 3:
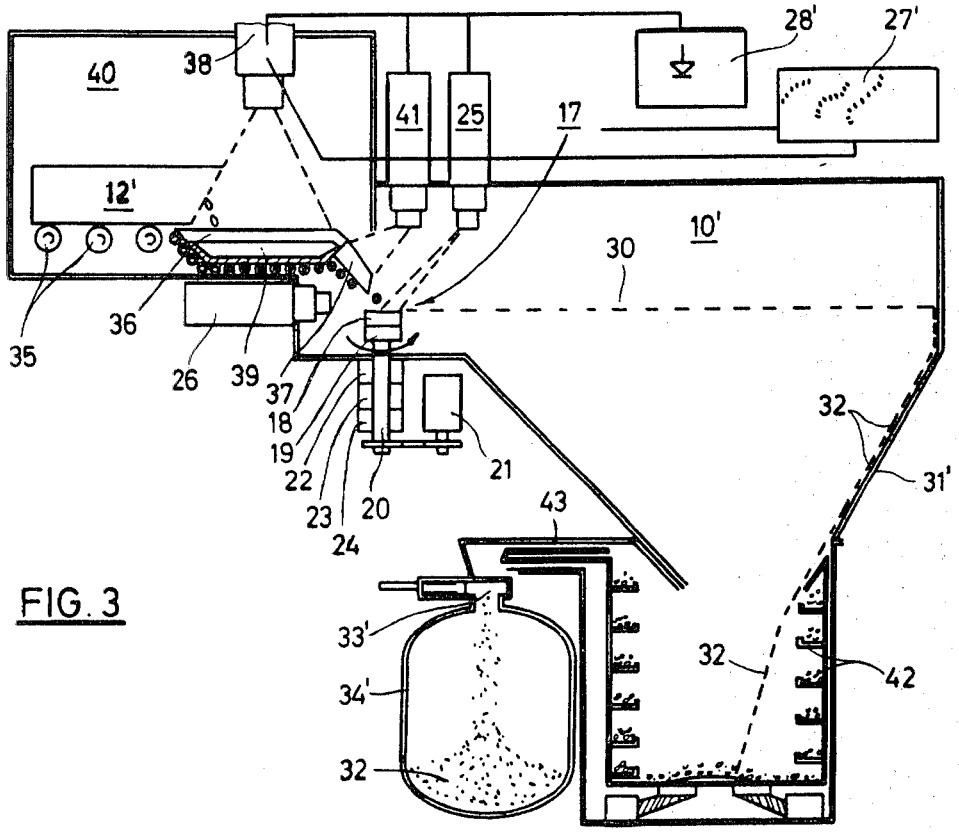

FIG. 1
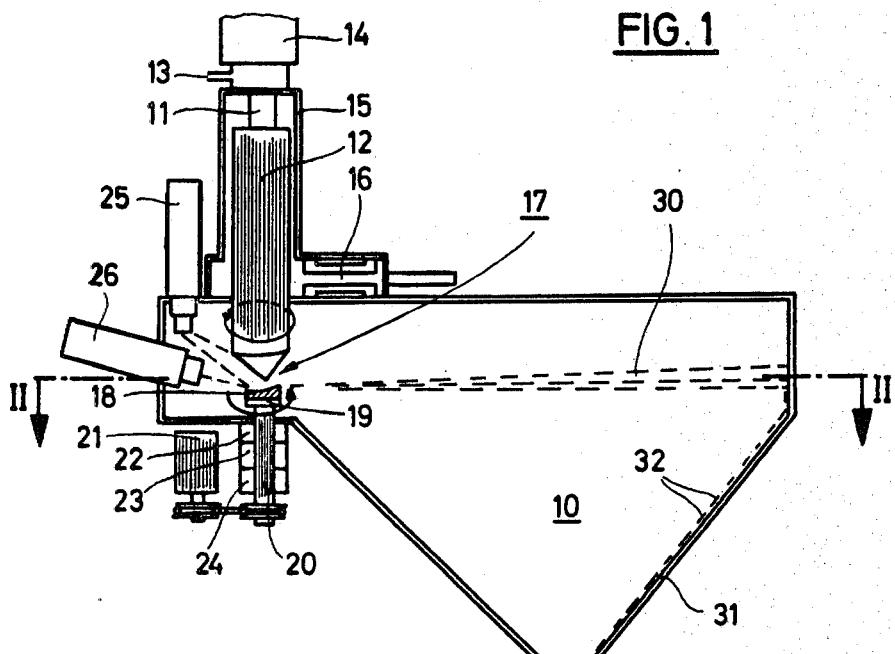
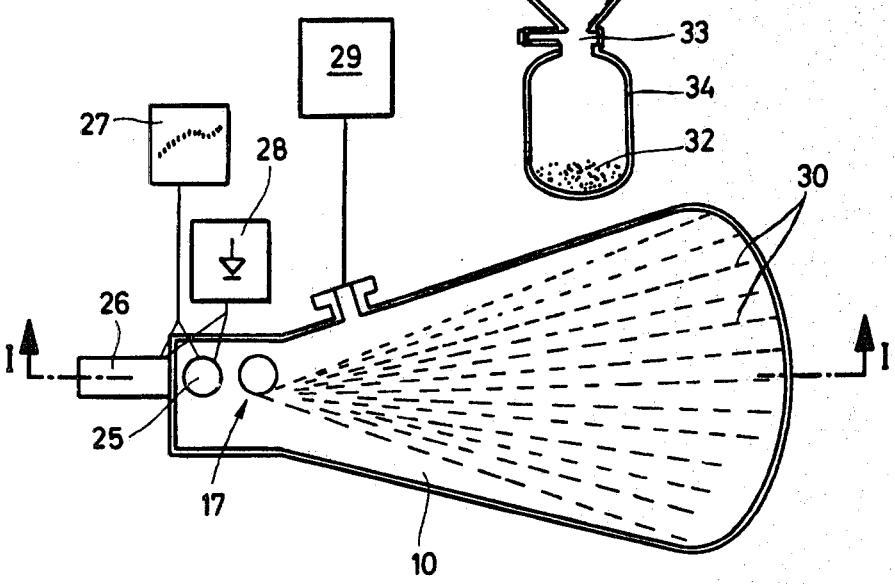
FIG. 2

APPARATUS FOR THE PRODUCTION OF HIGH-PURITY METAL POWDER BY MEANS OF ELECTRON BEAM HEATING

This is a division of application Ser. No. 902,475 filed May 7, 1978 which is now U.S. Pat. No. 4,218,410, which is a continuation of application Ser. No. 697,283 filed June 17, 1976 and now abandoned.

BACKGROUND

The invention relates to an apparatus for producing high-purity metal powder by the electron beam melting of bars of material in a vacuum, momentarily catching the molten material on a plate spinning at high speed from which particles of the material are flung and then solidified by the removal of heat.

Metal powders are required for a number of purposes, of which only sintered metal products and surface coatings will be mentioned here by way of example. A number of superalloys can be produced with satisfactory material characteristics only if they are made from powdered metals. In order to achieve optimum properties in the finished product it is necessary that the metal powder that is produced have a very precise particle size spectrum. In addition, the metal powder must be produced in a very pure state and must contain no products of reaction with atmospheric oxygen or other reactive gases when it enters the sintering process. Hollow spheres and foreign substances in and between the particles are to be avoided. In particular the powder particles must be free of oxide coatings. To satisfy this requirement, the electron beam heating system must be provided with the high vacuum of $10^{-4}$ bar and less that is needed for the unhampered flight of the electrons.

As a consequence of the application of the vacuum, however, the transition from the molten to the solid state, i.e., the removal of the melting heat, can be brought about exclusively by radiation losses during the free flight of the metal particles, unless other, serious disadvantages can be accepted. The removal of heat by convection and conduction is impossible, as is also the use of a cooling and quenching liquid within the evacuated chamber. The removal of heat by radiation must result in the solidification of the metal particles before they contact one another or any solid object. If the metal particles touch one another they cake together, and if they contact some other solid object they become flattened and this is undesirable for most applications. These circumstances necessitate flight paths of considerable length. On the other hand, short flight paths are desirable on account of the necessary dimensions of the vacuum chambers, on whose volume depends not only the time required for evacuation but also the choice of the pump system. But in most cases the required particle size is specified and this precludes flexibility as regards the size of the powder producing apparatus.

German "Auslegeschrift" No. 1,291,842 discloses a method of producing metal powder by means of electron beams, in which the rod which is to be made into powder is itself rotated at high speed. The end of the rod is bombarded with electron beams such that molten particles are flung outwardly by centrifugal force. On account of the relationship between the diameter of the rod and the flight path or cooling rate of the particles, and hence the volume of the vacuum chamber, the spinning rod can have only a limited diameter. For a specific amount of the powder, therefore, the apparatus has to be fed either with a rod of sufficient length or with a number of short rods. Reloading necessitates shutting down the powder making system and long, thin rods, due to unavoidable instabilities, cannot be spun at sufficiently high speed since it is impossible to support them over their entire length. Furthermore, the cooling of the metal particles is accomplished at least partially by impact and the removal of heat on a cooled surface, so that the shape of the solidified metal particles departs from the spherical. Lastly, however, the metal particles are flung away from the spinning rod in all directions, so that the cooled wall must be rotationally symmetrical with respect to the rod. The principal disadvantage is that, in addition to the above-indicated disadvantages as regards the quality of the powder, the vacuum chamber must possess a rather large volume.

German Pat. No. 1,280,501 and German "Auslegeschrift" 1,565,047 furthermore disclose methods for the production of metal powder by electron bombardment, in which the molten metal drops onto the vibrating surface of a receiver vibrating at high or ultrasonic frequency. The production capacity of such an installation, however, is very limited, since the vibrating receiver can be fed only a very small amount of molten metal per unit of time. Also, metal powders having a broad particle size distribution are produced. Above all, however, the vibrating receiver propagates the metal particles in uncontrolled directions, so that the receiver must be located substantially in the center of the vacuum chamber which must be dimensioned accordingly. The flight paths of the metal particles in all directions again determine the size and shape of the vacuum chamber. Premature collision between the still hot metal particles results in a caking or sintering of the particles.

Lastly, German "Auslegeschrift" No. 1,783,089 discloses a process of the initially described kind, in which the molten metal impinges upon a plate which is spinning at a high speed. In this case, again, the metal particles produced by centrifugal force are flung from the entire circumference of the plate. Solidification by removal of heat is accomplished in this case by a cooling jacket surrounding the spinning plate in very close proximity thereto, so that the early impingement of the molten particles upon this cooling jacket results in the production of virtually naught but flake-like granules. Even so, the volume of the vacuum chamber cannot be reduced to the desired extent.

THE INVENTION

The invention is addressed to the object of providing an apparatus whereby metal particles of substantially spherical shape can be produced at a given rate, whose diameter will be within an extremely precise and controllable range of tolerance, and in which the vacuum chamber can be given a minimal volume even though the metal particles are cooled exclusively by radiation losses during free flight.

The object of the invention is accomplished in conjunction with the initially described process by bombarding the metal on the spinning plate with an electron beam that is so focussed and periodically deflected that its focal point is many times smaller than the diameter of the spinning plate, and moves back and forth between the rotational center of the spinning plate and the margin thereof so that it scans the spinning plate over an area that is small in relation to the diameter of the plate and extends radially of the axis of rotation of the plate, and the withdrawal of heat to the point of solidification is accomplished substantially by radiation loss.

The basis of the invention is the surprising discovery that the metal particles, in the application of the invention, are released from the spinning plate only within a narrow angular range whose position is stable, while the remaining portion of the circumference of the spinning plate does not serve for the release of metal particles. The position and the size of this angular area remain unvaried, i.e., stable, but they can be controlled within certain limits by the location and intensity of the bombardment and by the shape of the spinning plate and its rotatory speed. This discovery was not foreseeable and it is to be attributed to the closely defined area of the spinning plate or of the metal thereon which is bombarded with electron beam energy.

The measures and means for the focusing and periodic deflection of an electron beam are state of the art and therefore are not explained in greater detail herein. The focusing, for example, is accomplished by means of an electromagnetic lens system. The periodical deflection of the electron beam is made possible, for example, by at least one deflection system consisting of a magnetic core with a winding, in which the winding is energized periodically by different deflection voltages. The precision that can be achieved today in the focusing and deflection of electron beams is so great that the method described, namely the bombardment of the spinning plate within a very closely defined zone, is entirely practicable. Additional details will be given in the description given below.

With the apparatus of the invention the advantage is achieved that the volume of the vacuum chamber and hence the evacuation time and the size of the pumping system required can be considerably reduced. Since the angle within which the metal particles are flung from the spinning plate is between about 30 degrees and a maximum of 90 degrees, the chamber volume, the pumping system and hence the investment costs connected with the vacuum chamber can be reduced to approximately one-eighth of the original amount. With regard to the smaller chamber volume, the advantage of the savings in construction cost and in weight results especially from the fact that the strength of the chamber walls can be kept sufficiently great in spite of considerable reduction in wall thickness.

The additional advantage achieved is that, due to the precise energetic conditions prevailing on the surface of the spinning plate, spherical metal particles are produced whose diameter is comprised within a very precise tolerance range. The average sphere diameter will be in accordance with the following equation:

$$d_{sphere} = \frac{c}{n \cdot \sqrt{D}}$$

wherein c is a constant which depends on the surface tension of the material and can be found in tables; n is the rotatory speed of the spinning plate and D is its diameter. From this it can be seen that the average sphere diameter can be influenced by the appropriate choice of the rotatory speed of the spinning plate and its diameter. Common diameters for such a spinning plate are approximately from 70 to 150 mm.

With spinning plates of such dimensions as these, it has been found to be especially advantageous if the spinning plate is driven at a speed between 3,600 and 15,000 rpm, and if the electron beam is deflected periodically at a frequency between 30 and 100 Hz, and if the focal spot diameter is between one-tenth and one one-hundredth of the diameter of the spinning plate. The relationship between the rotatory speed and the deflection frequency is to be understood to mean that the lower frequency is to be associated with the lower spinning plate speed.

The timing of the deflection voltage, which determines the location of the focal spot and the time for which it dwells on a particular location, is to be selected on the basis of bombarding the spinning plate with the same thermal power per unit of surface area. Particularly simple conditions, and conditions which are easy to achieve as regards the system of electrical control, can be created by controlling the beam deflection by increasing the deflection voltage in steps such that the briefly dwelling focal spots will be arrayed radially of the axis of rotation of the spinning plate, and if the relative dwell time increases with the distance of the spot from the axis of rotation.

An especially advantageous further development of the method of the invention is characterized in that the metal melted from the rod-like starting material is fed to the spinning plate through an electron beam heated intermediate reservoir. This intermediate reservoir creates the possibility of compensating the various rates at which the starting material drips from the rod by providing a storage reservoir, superheating the molten metal at least locally, and increasing the refining action through longer residence times. The intermediate reservoir thus also permits better control of the process as well as the settling out of unfusible impurities.

An additional advantage is achieved if the solidified metal powder is fed to a powder container by means of a transport system operating on the principle of the jogging conveyor. A conveyor of the type known as the spiral conveyor has proven especially suitable for this purpose. The metal that has solidified in free flight, i.e., without contacting solid cooling surfaces, still has a rather high temperature. Under the effect of this temperature combined with an appreciable fall distance the metal particles might, under unfavorable circumstances, have a tendency to cake up. The jogging conveyor can not only contribute to a more rapid cooling of the powder by drawing heat from it to the surroundings, but also it can more reliably prevent any sintering together of the surfaces by imparting a vibratory movement to the powder.

Lastly, it is possible, if the rod-like starting material is fed downwardly, to obtain the special advantage of being able to rotate the rod at a low rotatory speed during the melting thereof, namely at speeds between about 5 and 20 revolutions per minute. This brings about not only a more uniform melting away of the starting material, which constitutes a fusing electrode, but also makes it possible by means of a single electron gun to melt rods having a considerably greater diameter than the spinning plate. Due to the constant rotation of the rod, an apex is formed on the latter, which, if the spinning plate and rod are in coaxial alignment, will be located directly over the center of the spinning plate. The molten droplets will at first run down the conical lower surface of the rod to the tip or apex of the cone, from which they will then fall in the form of drops or a thin stream. The use of a starting material in the form of rods of large diameter has the advantage that the powder producing apparatus will have to be charged less frequently.

An apparatus for the performance of the conventional process is described, for example, in German "Auslegeschrift" No. 1,783,089. It consists of a vacuum chamber, a system for holding and feeding the starting material in rod form, at least one electron beam generator, a spinning plate disposed in the path of the falling molten metal, a drive for the spinning plate, and a powder collecting container.

An apparatus of this kind for the performance of the process of the invention is characterized, in accordance with the further invention, in that the spinning plate is disposed eccentrically in the vacuum chamber, that the vacuum chamber is in the form of a lateral pocket adjoining the space about the spinning plate, the dimensions and shape of the pocket being adapted to the flight paths of the metal particles until the latter solidify, and that a deflection control unit is associated with the electron beam generator, whereby the spinning plate is scanned by the beam in such a spatial relationship to the pocket that the flight paths of the metal particles all run within the pocket.

On account of the above-described location and form of the flight paths, the lateral pocket will have a shape corresponding approximately to that of a slice of pie, the spinning plate being located at the tip of the slice. It is in this manner that the extremely great reduction is achieved in the bulk and investment cost of such an installation.

The area scanned on the spinning plate can be controlled by varying the deflection voltage—or voltages in the case of composite deflection systems—and by simple trial and error.

Embodiments of the invention, their manner of operation, and important features thereof will be described hereinbelow with the aid of the drawings.

Figure 4:
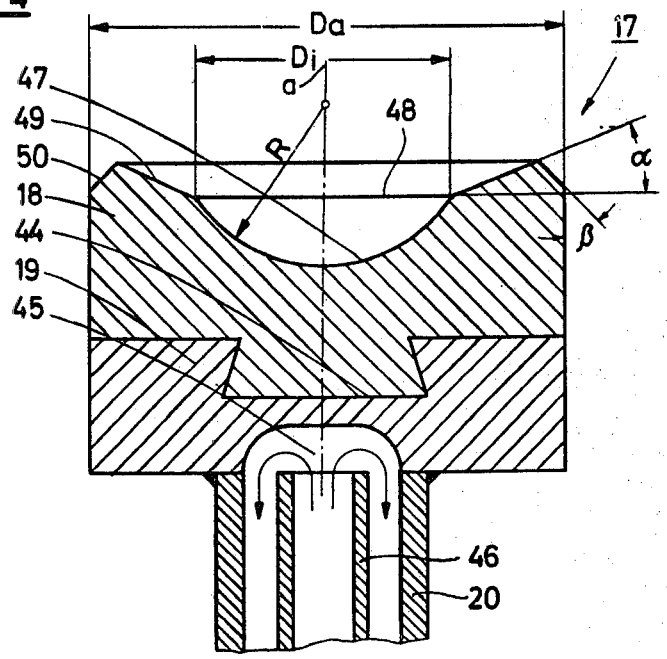
Figure 5:
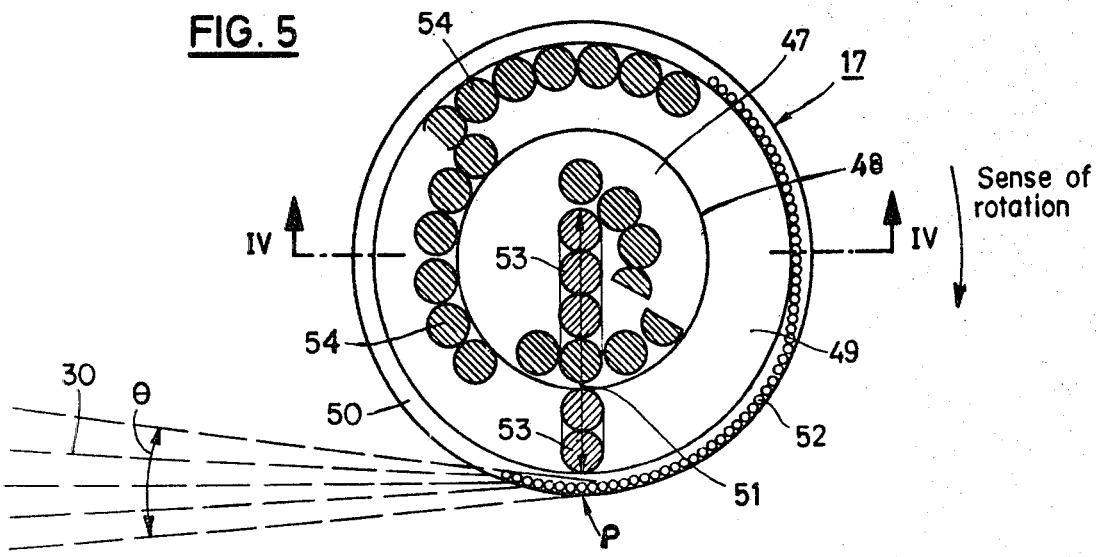

FIG. 1 is a vertical cross-sectional view taken along the axes of the starting material and spinning plate through a diagrammatically represented complete apparatus, on the line I—I of FIG. 2, FIG. 2 is a horizontal cross-sectional view taken along line II—II of FIG. 1, FIG. 3 is a vertical cross-sectional view like FIG. 1 but of an apparatus which is equipped with an intermediate reservoir between the starting material and the spinning plate, and also with a system for the transport of the metal powder, FIG. 4 is a vertical cross-sectional view taken through the axis of rotation of a spinning plate along line IV—IV in FIG. 5, on a substantially larger scale than in FIG. 1, and FIG. 5 is a top plan view of the subject of FIG. 4.

It has been found that a particularly accurate spectrum of particle diameters can be achieved if the spinning plate has on its upper side a substantially cup-shaped central recess whose rim adjoins a substantially hollow conical marginal area having a slight upward slope "$\alpha$" which is slightly less steep than the slope immediately below the rim of the central cup. The configuration of the spinning plate will then be somewhat similar to that of a soup plate. Particularly favorable conditions are brought about if the diameter "$D_i$" of the cup rim is smaller by from 20 to 60 mm than the outside diameter "$D_a$" of the spinning plate, if the radius "R" of the cup-shaped recess is between 0.6 and 1.0 times the cup rim diameter $D_i$, and if the slope angle "$\alpha$" in the marginal area is between 5 and 60 degrees, preferably between 10 and 20 degrees. It is to be understood that the inverted hollow truncated cone thus formed is open at the top.

For reasons of ease of manufacture and repair it is desirable that the recess be made in a replaceable top portion of the spinning plate, and that the receptacle for the top portion be provided with passages for coolant. It is especially desirable that the top portion be made of the same material as the powder.

By dividing the apparatus into individual chambers with shut-off valves in the manner of an air-lock system, simplicity can be achieved in supplying the apparatus with fresh starting material and removing the powder without having to relieve the vacuum in the actual dust producing chamber.

Referring to FIGS. 1 and 2 there is provided a vacuum chamber 10 with which there is associated a holding and advancing device 11 constructed as an electrode shank for starting material 12 in rod form. Since this starting material must be included in the circuit of the corresponding electron beam gun, it is also referred to as a fusing electrode. A pressure gradient system for the passthrough of the electrode shank is identified as 13 and is associated with a drive system 14. With the vacuum chamber 10 there is furthermore associated an extension chamber 15 which surrounds the starting material 12 and consequently can be referred to also as an electrode chamber. Between the vacuum chamber 10 and the extension chamber 15 there is a shut-off valve 16, so that the extension chamber 15 can serve as a material loading airlock.

Under the action of the drive 14, the starting material rod 12 performs a movement composed of advancement and rotation, the rate of advancement being governed by the rate at which the starting material melts away. Underneath the central axis or axis of rotation of the starting material rod 12 there is a spinning plate 17 which consists of a replaceable top portion 18 made of the same material as the starting material, as well as a rotating receptacle 19 for accommodating the top portion 18. The receptacle 19 is affixed on a shaft 20 which can be raised to a high rotatory speed by a drive means 21 which is an electric motor. The shaft 20 is passed into the vacuum chamber through a vacuum seal 22, a bearing 23 and a cooling water connecting head 24.

Adjacent the starting material 12 and the spinning plate 17 are two electron beam generators 25 and 26 of known construction, which are equipped with systems not further described for the focusing and deflection of one electron beam each. The electron beam generator 25 serves for melting away the rod-like starting material 12 and for the distribution of the molten metal on the spinning plate 17. The electron beam generator 26 performs the function of the invention, i.e., it directs against the metal on the spinning plate an electron beam which is so focused and periodically deflected that its focal spot is many times smaller than the diameter of the spinning plate, and that the beam deflection between the center of rotation of the spinning plate and its outer margin 50 (see FIG. 4) takes place in such a manner that the spinning plate is scanned in a zone which extends radially of the axis of rotation of the spinning plate and which is short in relation to its diameter. This radial zone includes areas 47 and 49 (see FIG. 4), and extends perpendicular to the plane of FIG. 1, between the axis of rotation and the marginal area of the spinning plate nearest the observer.

For the proper control or regulation of the electron beam generators 25 and 26, an electron beam programming apparatus 27 is provided. The electron beam generators are provided with power from a high voltage apparatus 28. A pump system for the production of the working vacuum required in the vacuum chamber 10 is generally designated at 29. Such apparatus are also state of the art and therefore are not further described.

From FIGS. 1 and 2 it can be seen that the parts of the apparatus described up to this point are located, along with the starting material to be made into powder, within a relatively small, lateral extension of the vacuum chamber 10, i.e., they are disposed eccentrically in the vacuum chamber. The largest part of the vacuum chamber 10 is in the form of a pocket which laterally adjoins the space around the spinning plate 17, the dimensions and shape of the pocket being designed to accommodate the flight paths 30 of the metal particles until they solidify. The flight paths 30 are clearly indicated in FIGS. 1 and 2; they diverge with increasing distance from the spinning plate 17 and fill an approximately wedge-shaped space having a relatively small aperture angle. This space is adapted to the cross section of the vacuum chamber 10 and to its lateral pocket. The vacuum chamber 10 continues downwardly through an approximately conical or pyramidal prolongation 31 which serves as a means of guiding the falling or rolling metal powder 32. At the lowermost point of the prolongation 31 is a shut-off valve 33 below which is a powder collector 34. The shutoff valve 33 enables the vacuum chamber 10 to be shut off and the powder collector 34 to be removed and emptied.

The manner of operation of the apparatus represented in the drawing is as follows: Metal drops fall continually from the bottom of the starting material 12, which assumes a tapered shape on account of the rotation and the electron bombardment, and they fall into the center of the recess 47 (see FIG. 4) in the spinning plate beneath the material. By continued bombardment with electron beams the metal drops are kept in the molten state and are driven increasingly by the surface of the spinning plate. Adhesion forces and the force of gravity deform the originally spherical drops to a pancake shape. This process is increasingly promoted by centrifugal force as the metal migrates from the center of the recess into the marginal area 49 (see FIG. 4). The particles of the "pancake" solidify, whereupon the electron beam melts other, previously solidified particles thereof. The centrifugal forces overcome the forces of adhesion, so that viscous metal particles, due to the maintenance of fluidity by electron beams, migrate toward the marginal area of the recess and pass over the edge of the plate in the configuration shown in FIG. 2.

In FIG. 3, the powder making apparatus is expanded as follows: The starting material 12′ in rod form is fed, not vertically downward as in FIG. 1, but horizontally from left to right. For this purpose it is mounted on a feeding system 35 in the form of transport rolls which are driven at a speed corresponding to the rate of ablation of the metal. A water-cooled intermediate reservoir 36 in the form of a shallow trough having an overflow spout 37 is disposed beneath the end at which the metal is melted. Above the intermediate reservoir 36 there is provided an electron beam generator 38 which serves for melting the starting material 12′ and for keeping the puddle of metal 39 in intermediate reservoir 36 in the molten state. Starting material 12′, advancing system 35, intermediate reservoir 36 and electron beam generator 38 are housed within a fusion chamber 40 which has the smallest possible volume and laterally adjoins the vacuum chamber 10′. The molten metal passes into the vacuum chamber 10′ through an overflow spout 37 beneath which the spinning plate 17 is disposed. Only one narrow connection between the fusion chamber 40 and the vacuum chamber 10′ is provided in the area of the overflow spout, so that splashes of metal cannot enter the powder producing chamber and contaminate the powder. An additional electron beam generator 41 is associated with the overflow spout 37 and serves to keep the metal running from the intermediate reservoir 36 onto the spinning plate 17 in the molten state. High voltage apparatus 28′ is provided for powering and electron beam programming apparatus 27′ is provided for controlling the beam generators 25, 41 and 38.

The prolongation 31′ of the vacuum tank 10′ is also of conical or truncated pyramid shape and, unlike the one in FIG. 1, it empties into a transport apparatus 42 in the form of a spiral conveyor and, on the basis of rotatory oscillatory movements conveys the metal powder 32 upwardly along a helical path. The metal powder is then carried by a transverse trough 43 through the shutoff valve 33′ into the powder container 34′. Details of the spiral conveyor pertain to the state of the art.

Details of the spinning plate spins about axis of rotation a and 17 are to be seen in FIGS. 4 and 5. The spinning plate consists of the replaceable top part 18 which is joined by a dovetail 44 to the table 19. The table 19 has a coolant passage 45 connected to the hollow shaft 20 through the water connection head 24. The division into inflow and outflow channels is created by means of the concentrically inserted tube 46.

On the top of the top part 18 there is provided a substantially cup-shaped central recess 47 whose rim 48 adjoins a marginal area 49 of substantially the shape of an inverted, truncated hollow cone. The top part 18 is chamfered on its outer circumferential edge, and thus forms a truncoconical outer margin 50.

The radius of the recess is marked R, and its diameter $D_i$. The outside diameter is $D_a$. The slope angle $\alpha$ of the marginal area 49 is given, as is the slope angle $\beta$ of the outer margin 50. The range of these magnitudes for design purposes are given in the general description of the invention. The angle $\alpha$ can be selected between 5 and 60 degrees, but preferably and in the present case it is 15 degrees. Angle $\beta$ can be between 45 and 90 degrees, but in the present case it is preferably 50 degrees. It is possible, of course, to omit the chamfering and refrain from forming any special outer margin 50.

The mechanism of the operation of the controlled spinning off of the metal particles will be further explained with reference to FIG. 5: The beam deflection is produced by the step-wise increasing of the deflection voltage such that the briefly dwelling focal spots will be arrayed in rows extending radially of the axis of rotation of the spinning plate. The amplitude or distance swept by the focal point is indicated in FIG. 5 by the double-headed arrow 51. The individual dwelling focal spots 53—with respect to the stationary spinning plate—are hatched diagonally upward from left to right. With respect to the rotating spinning plate the individual focal spots 54 will be in the positions indicated by hatching diagonally upward from right to left. It can be seen that the relative dwell time of the focal spot is made longer as the distance from the axis of rotation increases. This is done so that the individual units of surface area of the spinning plate will receive equal amounts of energy per unit of time. The take-off bases for the flight of the individual metal particles are indicated by the small circles 52 in the area of the outer margin 50. On the basis of the position given in FIG. 5 for the oscillation of the electron beam, the flight paths of the metal particles will be as represented by the droplets leaving from point P and having an angular range $\theta$.

It can be seen that the focusing of the electron beam is selected such that the focal spot is many times smaller than the diameter of the spinning plate.

What is claimed is:

1. An apparatus for making high-purity metal powder from high purity metal while maintaining the initial high purity of the starting material, comprising:

a. a circular plate having a given diameter and a circumferential marginal area and means for rotating same at a high speed about a vertical axis of rotation corresponding to the center of the plate;

b. means for electron beam melting high purity metal starting material in rod form in vacuo into molten metal droplets directed onto the circular plate;

c. means for producing an electron beam focusable to a given focal spot on the plate and for focusing the focal spot such that its diameter is many times smaller than the given diameter of the plate and deflecting the beam between the rotational center of the spinning plate and the marginal area to effect the scanning of the plate in a zone that extends radially of the axis of rotation of the plate to said marginal area when the plate is spinning to direct the molten metal droplets by centrifugal force from the plate when it is spinning in a controlled manner within a fixed narrow angular portion of the circumference of the spinning plate to define a fixed narrow angular range of flight paths of the molten metal droplets leaving the plate; and d. means for collecting the metal particles formed from the droplets undergoing cooling and solidification due to loss of heat due to radiation during flight to form the metal powder.

2. Apparatus of claim 1, wherein the spinnable plate has on its upper side a substantially cup-shaped, central recess, wherein the marginal area is a substantially hollow conical zone adjoining the rim of the recess and having a smaller angle of inclination than the angel of inclination of the recess immediately preceding the rim.

3. Apparatus of claim 2, wherein the diameter $D_i$ of the rim is smaller by between 20 to 60 mm than the outside diameter D of the spinning plate, the radius R of the cup-shaped recess is between 0.6 and 1.0 times $D_i$, and the angle of inclination of the marginal area is between 5 degrees and 60 degrees.

4. Apparatus of claim 2, wherein the recess is disposed in a replaceable top part of the spinning plate, and the receptacle for the top part is provided with a coolant passage.

5. Apparatus of claim 1, wherein the means for melting comprises vacuum chamber means having an extension chamber which can receive the rod-like starting material and means for shutting off the extension chamber with respect to the vacuum chamber comprising a shut-off valve.

6. Apparatus of claim 1, wherein the means for melting comprises an electron beam-heated intermediate reservoir disposed between the rod-shaped starting material and the spinnable plate in the path of the molten starting material and having an overflow spout above the spinnable plate.

7. Apparatus of claim 1, wherein the melting means comprises a vacuum chamber and the collecting means comprises a powder collecting chamber and a jogging conveyor disposed between the vacuum chamber and the powder collecting container.

8. Apparatus of claim 7, wherein the jogging conveyor comprises a spiral conveyor.

9. Apparatus of claim 1, wherein the means for rotating the plate drives same at a rotatory speed between 3,600 and 15,000 rpm, and wherein the means producing the electron beam periodically deflects same with a frequency between 30 and 100 Hz and focuses the focal spot diameter between 1/10 and 1/100 of the diameter of the spinning plate.

10. Apparatus of claim 1, wherein the means for producing the beam includes means for producing a stepwise deflection voltage elevation to form briefly dwelling focal spots arranged radially of the axis of rotation of the plate and having relative dwell times which are longer as the distance from the axis of rotation increases.

11. Apparatus of claim 1, wherein the melting means comprises an electron beam-heated intermediate reservoir through which the metal melted away from the rod-shaped starting material is fed to the spinning plate.

12. Apparatus of claim 1, wherein the melting means includes means for rotating the rod-shaped starting material at low rotatory speed during the melting.

* * * * *

UNITED STATES PATENT AND TRADEMARK OFFICE

CERTIFICATE OF CORRECTION

PATENT NO. : 4,295,808

DATED : Oct. 20, 1981

INVENTOR(S) : Herbert Stephan et al

It is certified that error appears in the above-identified patent and that said Letters Patent are hereby corrected as shown below:

| COLUMN | LINE | |
|---|---|---|
| Title Page Related U.S. appl. | | Delete "May 7" and insert --May 3--. |
| 1 | 7 | Delete "May 7" and insert --May 3--. |

Signed and Sealed this

Eighteenth Day of May 1982

[SEAL]

Attest:

GERALD J. MOSSINGHOFF

Attesting Officer

Commissioner of Patents and Trademarks